US009302298B2

(12) United States Patent
Tokoshima et al.

(10) Patent No.: US 9,302,298 B2
(45) Date of Patent: Apr. 5, 2016

(54) DEVICE FOR SUPPLYING WATER CONTAINING DISSOLVED GAS AND PROCESS FOR PRODUCING WATER CONTAINING DISSOLVED GAS

(75) Inventors: Hiroto Tokoshima, Tokyo (JP); Keita Seo, Tokyo (JP)

(73) Assignee: KURITA WATER INDUSTRIES, LTD., Tokyo (JP)

( * ) Notice: Subject to any disclaimer, the term of this patent is extended or adjusted under 35 U.S.C. 154(b) by 933 days.

(21) Appl. No.: 13/138,655

(22) PCT Filed: Mar. 29, 2010

(86) PCT No.: PCT/JP2010/055551

§ 371 (c)(1),
(2), (4) Date: Nov. 15, 2011

(87) PCT Pub. No.: WO2010/113863

PCT Pub. Date: Oct. 7, 2010

(65) Prior Publication Data

US 2012/0048383 A1 Mar. 1, 2012

(30) Foreign Application Priority Data

Mar. 31, 2009 (JP) ..... 2009-086343

(51) Int. Cl.

| | |
|---|---|
| ***B01F 3/04*** | (2006.01) |
| ***B08B 3/08*** | (2006.01) |
| ***B01F 15/00*** | (2006.01) |

(52) U.S. Cl.

CPC ..... *B08B 3/08* (2013.01); *B01F 3/04269* (2013.01); *B01F 15/0022* (2013.01); *B01F 15/00344* (2013.01); *B01F 2003/04404* (2013.01); *B01F 2215/0096* (2013.01); *Y10T 137/0318* (2015.04); *Y10T 137/8158* (2015.04); *Y10T 137/86083* (2015.04)

(58) Field of Classification Search

CPC ..... B01F 3/04269; B01F 15/0022; B01F 15/00344; B01F 2003/04404; B01F 2215/0096; B08B 3/08; Y10T 137/8158; Y10T 137/86083; Y10T 137/0318

USPC ..... 261/102, 105, 122.1

See application file for complete search history.

(56) References Cited

U.S. PATENT DOCUMENTS

| | | | | |
|---|---|---|---|---|
| 7,237,562 | B2 * | 7/2007 | Shibayama | 134/56 R |
| 2003/0230236 | A1 * | 12/2003 | Shibayama | 117/200 |
| 2003/0234030 | A1 | 12/2003 | Shibayama | |
| 2008/0118418 | A1 * | 5/2008 | Morita | 422/255 |
| 2011/0180148 | A1 * | 7/2011 | Xia et al. | 137/1 |

FOREIGN PATENT DOCUMENTS

| | | |
|---|---|---|
| JP | H11-057707 | 3/1999 |
| JP | H11-077023 | 3/1999 |
| JP | 2000-189742 A | 7/2000 |

(Continued)

*Primary Examiner* — Charles Bushey

(74) *Attorney, Agent, or Firm* — Manabu Kanesaka

(57) ABSTRACT

A device for supplying water containing dissolved gas includes a gas permeable film module that is partitioned into a gas phase chamber having a connection port at a bottom part and a liquid phase chamber by a gas permeable film, a feed unit feeding water to be treated to the liquid phase chamber, a gas supply unit supplying gas to the gas phase chamber, and a vacuum evacuation unit, connected with the gas phase chamber with the connection port, so that the gas is supplied to the gas phase chamber by the gas supply unit while the gas phase chamber is evacuated by the vacuum evacuation unit.

2 Claims, 1 Drawing Sheet

(56) References Cited

FOREIGN PATENT DOCUMENTS

| | | | |
|---|---|---|---|
| JP | 2003-010661 | A | 1/2003 |
| JP | 2005-270793 | A | 10/2005 |
| JP | 2007-185559 | | 7/2007 |
| JP | 2007-319843 | A | 12/2007 |

* cited by examiner

DEVICE FOR SUPPLYING WATER CONTAINING DISSOLVED GAS AND PROCESS FOR PRODUCING WATER CONTAINING DISSOLVED GAS

FIELD OF INVENTION

The present invention relates to a device for supplying water containing dissolved gas and a process for producing water containing dissolved gas, and more specifically, relates to; a device for supplying water containing dissolved gas, wherein the device has a gas permeable film module partitioned by a gas permeable film into a gas phase chamber and a liquid phase chamber, wherein water to be treated is fed to the liquid-phase chamber and gas is supplied to the gasphase chamber, and then the gas in the gas phase chamber permeates the gas-permeable film and dissolves in the water to be treated in the liquid phase chamber, wherein the water thus treated constitutes the water containing dissolved gas; and a process for producing water containing dissolved gas using the device for supplying water containing dissolved gas.

BACKGROUND OF INVENTION

Conventionally, cleaning of silicon substrates, and glass substrates, which are to be used for semiconductor devices and liquid crystal devices, respectively, and other types of substrate has been primarily conducted by the so-called RCA cleaning method. By this method, these substrates are cleaned at a high temperature using a concentrated hydrogen peroxide based chemical solution such as a mixture of hydrogen peroxide solution and sulfuric acid; a mixture of hydrogen peroxide solution, hydrochloric acid, and water; or a mixture of hydrogen peroxide solution, ammonia solution, and water, and then rinsed the substrates with ultrapure water. However, this RCA cleaning method uses large quantities of hydrogen peroxide solution, highly concentrated acids, highly concentrated alkalies, and the like, thus the costs for chemical solutions are high. Additionally, ultrapure water for rinsing, waste liquid treatment, ventilation, i.e., discharging chemical vapor and preparing clean air and the like entail a lot of costs.

In view of such situation, various measures intended to reduce costs in the cleaning process and to lessen the adverse impact on the environment have been taken and in this regard several achievements have been made. A typical example of such an achievement is a technique for cleaning a treated object by ultrasonic cleaning and the like using water containing dissolved gas in which a specific gas is dissolved. The specific gas may be an oxygen gas, ozone, carbon dioxide gas, a rare gas, an inert gas or a hydrogen gas.

As a process for producing such water containing dissolved gas, a process using a film module with a built-in gas permeable film is known. In the process, water is fed to the liquid-phase side of the gas permeable film and a specific gas is supplied to the gasphase side of the gas permeable film. By permeating the gas permeable film, the gas in the gasphase side dissolves into the water in the liquid-phase side, and thus water containing dissolved gas is produced.

For example, Japanese Patent Publication 11-077023A describes a process of deaerating ultrapure water thus reducing the saturation degree of dissolved gas, and then dissolving hydrogen gas into the ultrapure water.

FIG. 2 is a process flow diagram illustrated in the publication mentioned above. Ultrapure water is fed through a flow meter 1 to a deaeration film module 2. In the deaeration film module 2, the gasphase side, which is separated from the ultrapure water by a gas permeable film, is kept in a decompressed state with a vacuum pump 3, thus gas dissolved in the ultrapure water is deaerated. The ultrapure water with its dissolved gas deaerated is then fed to a hydrogen gas dissolution film module 4. In the hydrogen gas dissolution film module 4, hydrogen gas supplied from a hydrogen gas feeder 5 is injected into the gas phase side and is fed to the ultrapure water through a gas permeable film. To the ultrapure water having dissolved hydrogen gas that has a desired concentration is added a chemical solution such as ammonia water conveyed from a chemical solution storage tank 6 with a chemical feeding pump 7, and the pH is adjusted to a predetermined value. Hydrogen gas is dissolved, and the alkaline turned hydrogen containing ultrapure water is finally fed to a precision filtration device 8 where fine particles are removed with an MF filter or the like.

With dissolved gas measurement sensors 9 installed at the inlet port and outlet port of the deaeration film module 2, the amounts of gas in the ultrapure water are measured and the saturation degrees are determined. Signals are sent to the vacuum pump, the saturation degrees of the ultrapure water are compared with the desired saturation degree, and the deaeration amount is adjusted. The adjustment of the deaeration amount is conducted by, for example, controlling the degree of vacuum by fixing the aperture of the vacuum degree controlling valve. The gas saturation degree of the ultrapure water after the deaeration is measured with dissolved gas measurement sensors 9, and the hydrogen gas concentration in the hydrogen containing ultrapure water that has flowed out of the hydrogen gas dissolution film module is measured with a dissolved hydrogen measurement sensor 9A. Signals representing these measurements are sent to the hydrogen gas feeder, and the feed amount of hydrogen gas is controlled by, for example, fixing the aperture of the valve installed in the feed route of hydrogen gas.

LIST OF DOCUMENT

Patent Document

Patent Document 1: Japanese Patent Publication 11-077023A

The gas permeable film of the hydrogen gas dissolution film module 4 described in the foregoing Japanese Patent Publication 11-077023A has a property of permeating only gas but not liquid, and water vapor permeates the gas permeable film. Thus, water vapor in the liquid phase chamber permeates the gas permeable film and diffuses and condenses in the gas phase chamber to be condensed water and remains in the gas phase chamber.

Here, when water containing dissolved gas in a low concentration (low saturation degree) of dissolved gas concentration on the order of μg/L (ppb) is produced, due to the influence of minimal changes in various conditions and the influence of the condensed water in the gas phase chamber of the gas dissolution film module (the hydrogen gas dissolution film module 4 in FIG. 2), it is difficult to stabilize the dissolved gas concentration in the water containing dissolved gas.

When water containing dissolved gas having a dissolved gas concentration on the order of mg/L (ppm), such as water containing carbon dioxide, is produced, and if the deaeration level of raw water (the extent of deaeration by the deaeration film module 2 in FIG. 2) is high, condensed water is prone to remain in the gas phase chamber of the gas dissolution film module (the hydrogen gas dissolution film module 4 in FIG. 2). The influence of the condensed water cannot be ignored, so it is difficult to stabilize the dissolved gas concentration in the water containing dissolved gas, as is the case with producing water containing dissolved gas having a dissolved gas concentration on the order of ppb mentioned above.

OBJECT OF INVENTION

The object of the present invention is to provide a device for supplying water containing dissolved gas, which is able to steadily supply water containing dissolved gas in a low concentration (low saturation degree) of dissolved gas concentration, and a process for producing water containing dissolved gas.

SUMMARY OF INVENTION

The first embodiment of the device for supplying water containing dissolved gas is characterized in that, in the device for supplying water containing dissolved gas having a gas permeable film module that is partitioned into a gas phase chamber and a liquid phase chamber by a gas permeable film, wherein water to be treated is fed to the liquidphase chamber by feed means and gas is supplied to the gasphase chamber by gas supply means, then the gas in the gas phase chamber permeates the gaspermeable film and dissolves in the water to be treated in the liquid phase chamber, and then the water thus treated constitutes the water containing dissolved gas, vacuum evacuation means is installed so that the gas is supplied to the gas phase chamber by the gas supply means while the gas phase chamber is evacuated by the vacuum evacuation means.

The second embodiment of the device for supplying water containing dissolved gas is characterized, according to the first embodiment, by having measurement means to measure the dissolved gas concentration of the water containing dissolved gas, and control means to control the dissolved gas concentration by adjusting the supply amount of the gas from the gas supply means in response to the measurement values determined by the measurement means.

The third embodiment of the device for supplying water containing dissolved gas is characterized, according to the first or second embodiment, in that a connecting port which leads to the vacuum evacuation means is provided at a lower portion of the air phase chamber.

The fourth embodiment of the device for supplying water containing dissolved gas is characterized, according to any one of the first to the third embodiments, in that the gas includes oxygen.

The fifth embodiment of the device for supplying water containing dissolved gas is characterized, according to the fourth embodiment, in that the dissolved gas concentration of the water containing dissolved gas is equal to or less than 1/400 of the solubility of the gas.

The sixth embodiment of the device for supplying water containing dissolved gas is characterized, according to any one of the first to the third embodiments, in that the gas includes carbon dioxide gas.

The seventh embodiment of the device for supplying water containing dissolved gas is characterized, according to the sixth embodiment, in that the dissolved gas concentration of the water containing dissolved gas is equal to or less than 1/50 of the solubility of the gas.

The eighth embodiment of the device for supplying water containing dissolved gas is characterized, according to any one of the first to the third embodiments, in that the gas includes at least one of nitrogen, argon, ozone, hydrogen, clean air and rare gas.

The ninth embodiment is a process for producing water containing dissolved gas using the device for supplying water containing dissolved gas, according to any one of the first to the eighth embodiments, characterized in that water to be treated is fed to the liquidphase chamber and gas is supplied to the gas phase chamber while the gas phase chamber is evacuated, then the gas in the gas phase chamber permeates the gaspermeable film and dissolves in the water to be treated in the liquid phase chamber, and then the water thus treated constitutes the water containing dissolved gas.

ADVANTAGES

In the device for supplying water containing dissolved gas and the process for producing water containing dissolved gas of the present invention, the gas is supplied to the gas phase chamber with gas supply means while the gas phase chamber is evacuated with the vacuum evacuation means. Thus, water containing dissolved gas in a low concentration (low saturation degree) of dissolved gas concentration can be steadily supplied.

Namely, a step of discharging condensed water is conventionally conducted when condensed water remains in the gas phase chamber, but during this step of discharging condensed water, pressure in the gas phase chamber changes, and consequently the dissolved gas concentration of water containing dissolved gas changes. In the present invention, the gas is provided to a gas phase chamber while the gas phase chamber is evacuated, so the condensed water in the gas phase chamber is constantly discharged by the evacuation. Accordingly, a step of discharging condensed water does not need to be separately conducted in the present invention, and a change in the dissolved gas concentration of water containing dissolved gas caused by the step of discharging condensed water is avoided. Thus, water containing dissolved gas having a desired dissolved gas concentration can be steadily supplied.

The present invention can be applied to a device for supplying water containing dissolved gas which steadily supplies water containing dissolved gas in a low concentration, and to a process for producing water containing dissolved gas. In Particular, the present invention is preferably applied to a device for supplying water containing dissolved gas and to a process for producing water containing dissolved gas, for producing water containing dissolved gas in a low concentration whose dissolved gas concentration is rigorously controlled, and for producing ultrapure water whose dissolved gas concentration is rigorously controlled, which are used in the cleaning process in the field of semiconductor industry.

As in the second embodiment, it is preferable to have measurement means to measure the dissolved gas concentration of the water containing dissolved gas, and control means to control the dissolved gas concentration by adjusting the supply amount of the gas from the gas supply means in response to the measurement values provided by the measurement means. By such feedback control, it is possible to supply water containing dissolved gas in a stable dissolved gas concentration even in a low concentration range (low saturation degree range).

As in the third embodiment, when a connecting port to vacuum evacuation means is fixed at the lower portion of the air phase chamber, condensed water remaining in the gas phase chamber can be discharged efficiently.

As in the fourth embodiment, the gas may include oxygen, in which case the dissolved gas concentration of the water containing dissolved gas is preferably equal to or less than 1/400 of the solubility of the gas as in the fifth embodiment.

As in the sixth embodiment, the gas may include carbon dioxide, in which case the dissolved gas concentration of the water containing dissolved gas is preferably equal to or less than 1/50 of the solubility of the gas as in the seventh embodiment.

As in the eighth embodiment, the gas may include at least one of nitrogen, argon, ozone, hydrogen, clean air and rare gas.

DESCRIPTION OF EMBODIMENTS

Figure 1:
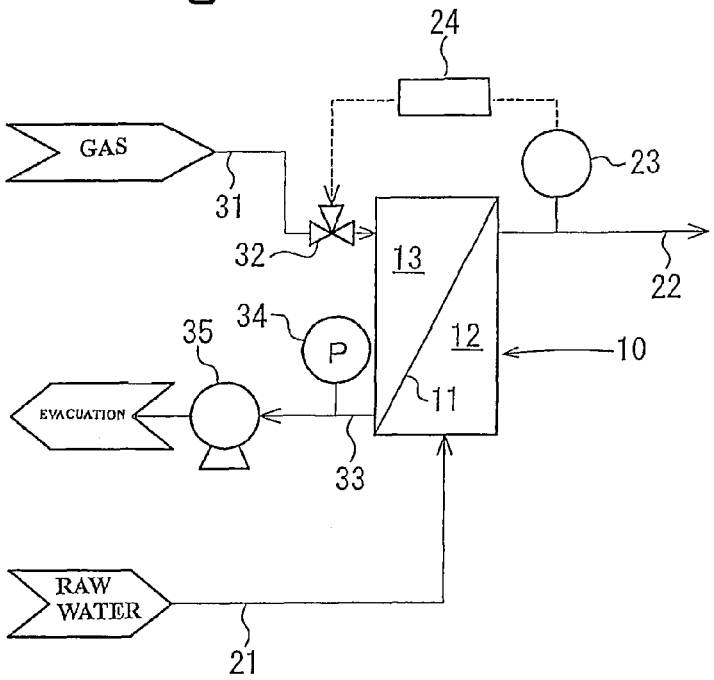
FIG. 1 is a system diagram of the device for supplying water containing dissolved gas according to an embodiment.

Embodiments of the present invention are hereafter described referring to the drawings. FIG. 1 illustrates a system diagram of the device for supplying water containing dissolved gas and the process for producing water containing dissolved gas according to the embodiments.

A raw water pipe 21 is connected to the lower portion of a liquid phase chamber 12 of a gas permeable film module 10.

The inside of the gas permeable film module 10 is partitioned by a gas permeable film 11 into a liquid phase chamber 12 and a gas phase chamber 13.

To the upper portion of the liquid phase chamber 12 is connected a water containing dissolved gas supply pipe 22 equipped with a dissolved gas concentration meter 23.

To the upper portion of the gas phase chamber 13 is connected an end of a gas supply pipe 31 equipped with a gas flow control valve 32. The other end of the gas supply pipe 31 is connected to a gas source such as a gas cylinder. To the lower portion of the gas phase chamber 13 is connected an evacuation pipe 33 equipped with a pressure gauge 34 and a vacuum pump 35. A detection signal from the dissolved gas concentration meter 23 is received by a control device 24. The control device 24 controls the gas flow control valve 32 so that the concentration detected by the dissolved gas concentration meter 23 is the target concentration.

Figure 2:
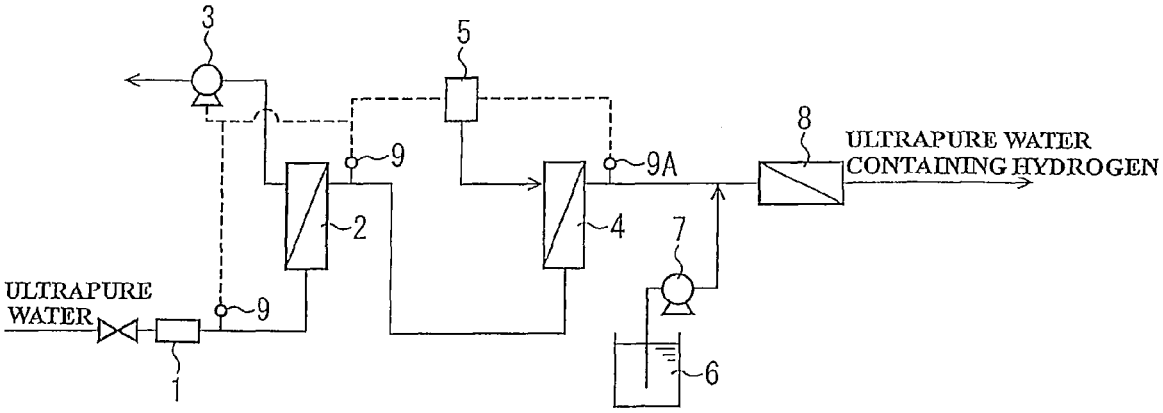
Fig. 2 Prior Art
FIG. 2 is a process flow diagram of producing water containing dissolved hydrogen gas according to a conventional example.

As will be mentioned later, water containing dissolved gas in a low concentration (low saturation degree) is produced by dissolving a target gas in raw water which is passed through the raw water pipe 21. For this reason, the raw water is preferably one in which substantially no target gas to be dissolved is dissolved, which is not saturated with gas other than the target gas and which is capable of dissolving the target gas without being supersaturated. Typically, deaerated water obtained by deaerating dissolved gas from ultrapure water and the like may be used. Deaeration can be conducted by using, for example, the deaeration film module 2 illustrated in FIG. 2.

There is no particular restriction as to the kind of the gas permeable film 11 used as long as water does not permeate the film, and the gas to be dissolved in water permeates the film. For example, the gas permeable film may be a polymer film such as polypropylene, polydimethylsiloxane, polycarbonate polydimethylsiloxane block copolymer, polyvinylphenol polydimethylsiloxane polysulfone block copolymer, poly(4-methylpentene-1), poly(2,6-dimethylphenylene oxide) or polytetrafluoroethylene.

There is no particular restriction as to the type of the vacuum pump 35. It may be a water ring type or a scroll type. However, vacuum pumps that use oil to generate vacuum may contaminate the gas permeable film 11 by reversely diffusing oil, so an oil-free type is preferred.

Gas supplied from the gas supply pipe 31 may be oxygen, carbon dioxide, nitrogen, argon, ozone, hydrogen, clean air, or a mixture gas of two or more of these gases.

These gases may be diluted with a dilution gas, in which case the dilution gas may be a rare gas such as argon or helium, inert gas such as nitrogen, carbon dioxide, clean air, a mixture gas of two or more of these gases, or the like.

The gas flow control valve 32 is preferably an oil-less type.

Next, an example of a process for producing water containing dissolved gas using a device for supplying water containing dissolved gas illustrated in FIG. 1 is described.

In the example, oxygen is used as the gas, and the water temperature is 25° C. The solubility of oxygen into water at 25° C. and at 1 atm is 40.9 mg/L.

By opening the gas flow control valve 32, oxygen gas is supplied from the gas supply pipe 31 to the gas phase chamber 13, and concurrently the vacuum pump 35 starts to operate and the gas phase chamber 13 is evacuated through the evacuation pipe 33. Raw water is supplied to the liquid phase chamber 12 from the raw water pipe 21.

Here, the degree of vacuum in the gas phase chamber 13 needs to be higher than the deaeration degree of raw water. This enables part of the gas (oxygen) in the gas phase chamber 13 to permeate the gas permeable film 11 and dissolve in the raw water in the liquid phase chamber 12. The pressure inside the gas phase chamber 13 is preferably equal to or less than −90 kPa, more preferably −90 to −97 kPa, and even more preferably −93 to −96 kPa. When the pressure is equal to or less than −90 kPa, condensed water in the gas phase chamber 13 can be well discharged.

Part of the oxygen supplied into the gas phase chamber 13 through the gas supply pipe 31 permeates the gas permeable film 11 and dissolves in the raw water in the liquid phase chamber 12, as described above. Water containing dissolved gas thus obtained flows out through the water containing dissolved gas supply pipe 22. The remaining oxygen supplied to the gas phase chamber 13, along with vapor water which permeated the gas permeable film 11 from the liquid phase chamber 12 and condensed water formed by condensation of the vapor water, are sucked by the vacuum pump 35 and are discharged through the evacuation pipe 33.

Dissolved oxygen concentration in the water containing dissolved gas in the water containing dissolved gas supply pipe 22 is measured with the dissolved gas concentration meter 23, and the measurement signal is received by the control device 24. The control device 24 adjusts the aperture of the gas flow control valve 32 so that the dissolved oxygen concentration indicated by the dissolved gas concentration meter 23 is the target value (or falls within the target range), and controls the gas flow. By such feedback control, water containing dissolved gas having desired dissolved gas concentration is produced.

The dissolved oxygen concentration in the water containing dissolved gas is adequately determined according to the intended application and the like of the water containing dissolved gas. For example, when it is used as water containing dissolved oxygen (cleaning water) of low concentration in the cleaning process in the field of semiconductor industry, the dissolved oxygen concentration is preferably 1 to 100 μg/L, and particularly 10 to 60 μg/L.

Raw water flow in the raw water pipe 21, for example, is in the order of 2 to 10 L/min, and oxygen flow in the gas supply pipe 31, for example, is in the order of 0.1 to 10 mL/min.

In the embodiment, condensed water in the gas phase chamber 13 is discharged by vacuum generated with the vacuum pump 35, which prevents the condensed water from remaining in the gas phase chamber 13. Therefore, a change in the dissolved gas concentration in the water containing dissolved gas caused by the pressure change in the gas phase chamber 13 entailed by discharging the condensed water remaining in the gas phase chamber 13, and a change in the dissolved gas concentration in the water containing dissolved gas caused by immersion of part of the gas permeable film 11 into the condensed water in the gas phase chamber 13 can be prevented. Particularly, in the embodiment, the discharge pipe 33 is connected to the lower portion of the gas phase chamber 13, so a situation where condensed water to remain in the gas phase chamber 13 can be sufficiently prevented.

In the embodiment, by the feedback control, water containing dissolved gas having dissolved gas concentration in a low concentration range or in a low saturation degree range can be steadily produced.

The above embodiment is an example of the present invention, and the present invention is not limited to the embodiment. The gas is not limited to oxygen, and, for example, carbon dioxide gas may be dissolved in raw water in place of oxygen. When water containing dissolved carbon dioxide is used in the cleaning process in the field of semiconductor industry, the dissolved carbon dioxide gas concentration is, for example, preferably 1 to 100 mg/L, and more preferably 10 to 60 mg/L.

When nitrogen is dissolved in raw water, the dissolved nitrogen gas concentration is, for example, preferably 1 to 50 μg/L, and particularly 5 to 30 μg/L. When argon is dissolved in raw water, the dissolved argon gas concentration is preferably 1 to 100 μg/L, and particularly 10 to 60 μg/L. When ozone is dissolved in raw water, the dissolved ozone gas concentration is preferably 10 to 1000 μg/L, and particularly 50 to 500 μg/L.

When hydrogen is dissolved in raw water, the dissolved hydrogen gas concentration is preferably 5 to 500 μg/L, and particularly 10 to 100 μg/L. When clean air is dissolved in raw water, the dissolved clean air concentration is preferably 1 to 50 μg/L, and particularly 5 to 30 μg/L.

EXAMPLES

The present invention is hereafter described in more detail by referring to an example and a comparative example.

As the device for supplying water containing dissolved gas, the device illustrated in FIG. 1 is used.

Specifications and operational conditions of a gas permeable film module 10 and a dissolved gas concentration meter 23 are as follows.

Gas Permeable Film Module: Celgard LLC, Dissolution Membrane (Product Name: Liqui-Cel)

Dissolved Gas Concentration Meter: Hack Ultra Analytics Japan, Dissolved Oxygen Meter, Model 3610

Feed Amount of Raw Water: 5 L/min

Required Dissolved Oxygen Concentration: 5 μg/L

Water Temperature: 25° C.

Example 1

The amount of oxygen gas supplied through the gas supply pipe 31 was controlled to be 0.5 mL (standard state)/min with the gas flow control valve 32. The gas phase chamber 13 was evacuated with the vacuum pump 35 so that the pressure in the gas phase chamber 13 was −97 kPa.

As a result, the dissolved oxygen concentration in the water containing dissolved oxygen was controlled continuously to be in the range of 5 μg/L±5% inclusive. Condensed water in the gas phase chamber 13 did not remain, and there was no need to separately conduct a condensed water discharge operation.

Comparative Example 1

Water containing dissolved oxygen was produced employing the same steps as in Example 1, except that the vacuum pump 35 was normally not in operation and evacuation of the gas phase chamber 13 was not conducted, and that the vacuum pump 35 was run to discharge condensed water when condensed water remained in the gas phase chamber 13.

As a result, when conducting the discharging operation of condensed water, a change in the dissolved oxygen concentration in the water containing dissolved oxygen in the range of 5 μg/L±20% or more was induced, and it was difficult to steadily supply water containing dissolved oxygen.

The present invention has been described in detail using specific embodiments, and it is obvious for a person skilled in the art that various conversions are possible without departing from the spirit or scope of the present invention.

The present application is based upon Japanese Patent Application No. 2009-086343 filed on Mar. 31, 2009, the entire contents of which are incorporated herein by reference.

The invention claimed is:

1. A process for producing water containing dissolved gas using a device for supplying water containing dissolved gas comprising:

a gas permeable film module that is partitioned into a gas phase chamber and a liquid phase chamber by a gas permeable film, the gas phase chamber having a gas supply portion at an upper portion and a connection port at a lower portion;

a feed unit feeding water to be treated to the liquid phase chamber;

a gas supply unit supplying gas to the gas phase chamber through the gas supply portion;

a vacuum evacuation unit connected with the gas phase chamber through the connection port; and a vacuum pump discharging condensed water in the gas phase chamber with vacuum generated therewith, the process comprising:

feeding the water to be treated to the liquid phase chamber, and supplying the gas to the gas phase chamber while the gas phase chamber is evacuated so that the gas supplied to the gas phase chamber through the gas supply portion by the gas supply unit is evacuated by the vacuum evacuation unit to thereby constantly discharge the condensed water in the gas phase chamber, wherein a degree of vacuum in the gas phase chamber is higher than a deaeration degree of the water to be treated so that the gas in the gas phase chamber permeates the gas permeable film and dissolves in the water to be treated in the liquid phase chamber to thereby produce the water containing dissolved gas, and the degree of vacuum in the gas phase chamber is equal to or less than −90 kPa.

2. The process according to claim 1, wherein the connection port has a pressure gauge measuring the degree of vacuum in the gas phase chamber.

* * * * *